US008680753B2

(12) United States Patent
Oechsle et al.

(10) Patent No.: US 8,680,753 B2
(45) Date of Patent: Mar. 25, 2014

(54) PAR38-COMPATIBLE SPOT/FLOOD LIGHT WITH LEDS

(76) Inventors: Walter Oechsle, Berwick Springs (AU); Manfred Oechsle, Castle Hill (AU)

( * ) Notice: Subject to any disclaimer, the term of this patent is extended or adjusted under 35 U.S.C. 154(b) by 0 days.

(21) Appl. No.: 12/707,773

(22) Filed: Feb. 18, 2010

(65) Prior Publication Data

US 2010/0295439 A1 Nov. 25, 2010

(51) Int. Cl.

| | |
|---|---|
| ***H01K 1/58*** | (2006.01) |
| ***F21V 7/00*** | (2006.01) |
| ***F21V 7/04*** | (2006.01) |

(52) U.S. Cl.
USPC ..... 313/46; 362/296.04; 362/296.08; 362/555

(58) Field of Classification Search
USPC ..... 313/46; 362/296.04, 296.08, 555
See application file for complete search history.

(56) References Cited

U.S. PATENT DOCUMENTS

| | | | | |
|---|---|---|---|---|
| 5,839,822 | A | 11/1998 | Oechsle | |
| 6,357,893 | B1 * | 3/2002 | Belliveau | 362/285 |
| 7,144,135 | B2 | 12/2006 | Martin et al. | |
| 2003/0137838 | A1 * | 7/2003 | Rizkin et al. | 362/240 |
| 2005/0111234 | A1 * | 5/2005 | Martin et al. | 362/555 |
| 2006/0227558 | A1 * | 10/2006 | Osawa et al. | 362/351 |
| 2007/0086199 | A1 * | 4/2007 | Demarest et al. | 362/441 |
| 2007/0253199 | A1 * | 11/2007 | Biello et al. | 362/267 |
| 2009/0086478 | A1 * | 4/2009 | Sanroma et al. | 362/234 |
| 2009/0103296 | A1 * | 4/2009 | Harbers et al. | 362/234 |
| 2009/0261707 | A1 * | 10/2009 | Liu et al. | 313/46 |
| 2010/0008086 | A1 * | 1/2010 | Broitzman | 362/231 |
| 2010/0060130 | A1 * | 3/2010 | Li | 313/46 |
| 2010/0061098 | A1 * | 3/2010 | Horng et al. | 362/253 |
| 2010/0102696 | A1 * | 4/2010 | Sun | 313/35 |
| 2010/0264799 | A1 * | 10/2010 | Liu et al. | 313/46 |
| 2011/0062868 | A1 * | 3/2011 | Domagala et al. | 315/32 |

FOREIGN PATENT DOCUMENTS

| | | |
|---|---|---|
| AU | 677927 | 5/1997 |

* cited by examiner

*Primary Examiner* — Joseph L Williams
(74) *Attorney, Agent, or Firm* — Michael D. Eisenberg

(57) ABSTRACT

A low voltage spot light for use as substitute for a mains voltage PAR38 reflector lamp which comprises a chamber for LED clusters with reflectors and an enclosure for an electronic power supply to step down the incoming mains voltage. The LED clusters are mounted in the central area of the heat sink within the chamber and are accessible via a removable window. The LED chamber is weatherproof ventilated to prevent condensation. The spotlight is designed for outdoor use in conjunction with the PAR38 style weather proof lamp holder but can be operated indoors from any standard E 27 lamp holder.

18 Claims, 1 Drawing Sheet

PAR38-COMPATIBLE SPOT/FLOOD LIGHT WITH LEDS

FIELD OF THE INVENTION

The present invention relates to spotlights and more particularly to a low voltage spotlight which can be used as a replacement for a standard mains voltage parabolic aluminised PAR38 reflector lamp for outdoor use. Mains voltage is the supply voltage as provided by the Electricity Supply Authority, typically: 110 or 220V 60 Hz USA, 230V 50 Hz Europe, 240V50 Hz Australia.

BACKGROUND OF THE INVENTION

A standard mains voltage spotlight widely used throughout the world is the PAR38 which consists of an incandescent light source usually of 120 to 150 watt rating mounted within a sealed glass enclosure. Their low installation costs—low purchase price and simple installation in conjunction with the PAR38 style lamp holder—have made it the most widely used spot light for ratings up to 150 W and outdoor applications. However being incandescent lamps their big disadvantages are low efficiency with high power consumption short service life Dangerously high surface temperatures.

Governments are now requesting the replacement of incandescent lamps with more efficient light sources.

Numerous designs of adaptor lights to replace incandescent lamps are available, however none of them entails a compact weatherproof fitting, which uses LEDs as light source and can be used in a weatherproof PAR38 style lamp holder as a substitute for PAR38 reflector lamps.

The spotlights which are the subject of this invention satisfy these difficult criteria and the term 'spotlight' as used throughout this specification includes within its scope lights, which are commonly referred to as 'floodlights'.

In my Australian Patent No. 677927, and U.S. Pat. No. 5,839,822, I describe a spotlight that permits a 120 W PAR38 lamp to be replaced with a 50 W ELV IRC halogen lamp.

Although fluorescent lamps are more efficient than ELV halogen lamps, they are not ideal as substitutes for spotlights where concentrated, natural, brilliant light with a full colour spectrum is required. With their large illuminated surface not all generated light can reach the reflector and therefore the efficiency is reduced. Their service life is only about 20% of the service life of LEDs and they produce dangerous industrial waste containing mercury. Also their service life is only about 5 times longer and they produce much industrial waste on replacement.

SUMMARY OF THE INVENTION

The invention entails a low voltage spotlight comprising two weatherproof enclosures separated by an air gap.

The rear end enclosure is made from plastics and houses an electronic power supply with insulated switch mode transformer for the mains voltage input and a constant current DC output for the LEDs with protection. The power supply is embedded in permanent elastic potting which in the plastics enclosure provides double insulation. The lid of this enclosure has a rim flange surrounding the forward end to accommodate the adhesive used for assembly and 3 integrated spacers which connect the 2 enclosures and provide a path for leads from the power supply to the LED cluster. The rear end of this enclosure has a mounting base with an Edison screw cap for fitting into the socket of a mains voltage PAR38 weather proof lamp holder. For indoor applications the spotlight can be operated from any standard E27 lamp holder.

The front end enclosure is made from Aluminium alloy and consists of a top chamber (or upper portion) which houses the LED cluster with reflectors or collimators and a lower tray (providing a lower portion) with a well protected ventilation vent in its centre. A heat sink dish made from 3 mm Aluminium alloy is clamped between the two sections. The dish is positioned between an upper and a lower portion of the LED chamber. The one piece heat sink has holes for internal ventilation and dark coating for good emissivity except in its central area where the LED cluster is mounted. The front of the chamber is enclosed by a removable transparent cover attached via an elastic weather proof annular seal with a dust and insect proof vent. The position of the vent can be adjusted by rotation of the transparent cover. Heat is conducted from the LED cluster into the dish and emitted from its surface to free flowing ambient air for cooling.

Currently 14 W suffice to produce a light beam comparable to a 100 W PAR38 lamp.

The weatherproof ventilation of the front end LED chamber inhibits or prevents condensation.

BRIEF DESCRIPTION OF THE DRAWINGS

The invention is now described with reference to the accompanying drawings in which.

DETAILED DESCRIPTION WITH RESPECT TO THE DRAWINGS

Figure 1:
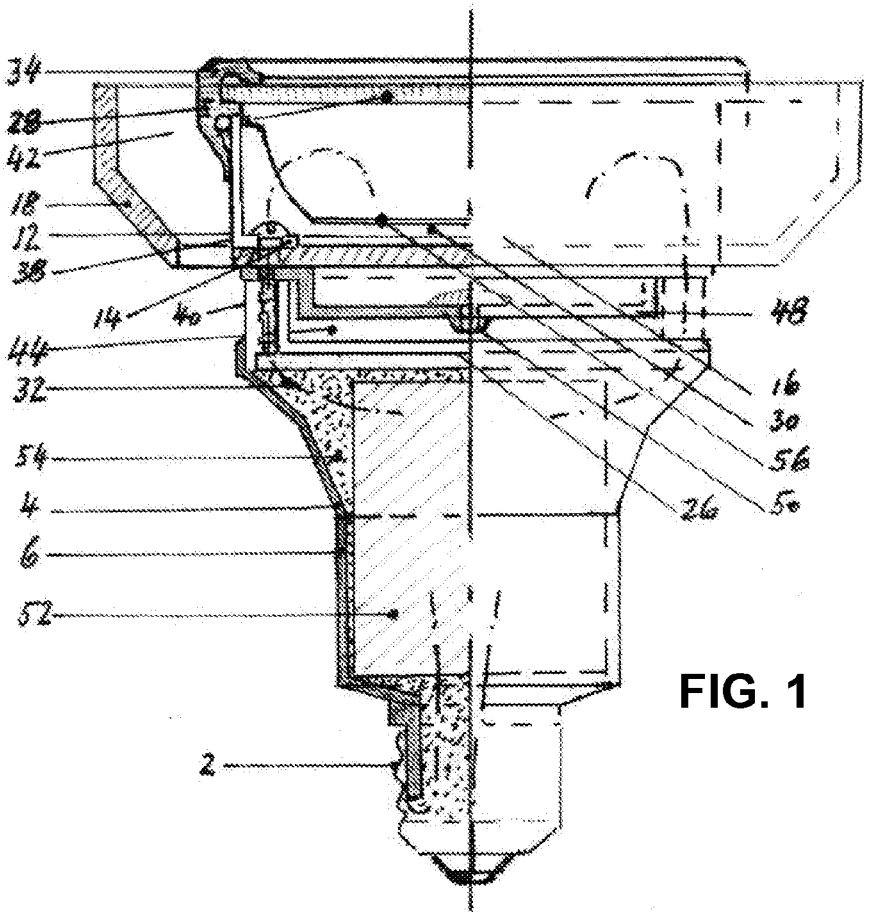
FIG. 1 is a section through a spot light.
Figure 2:
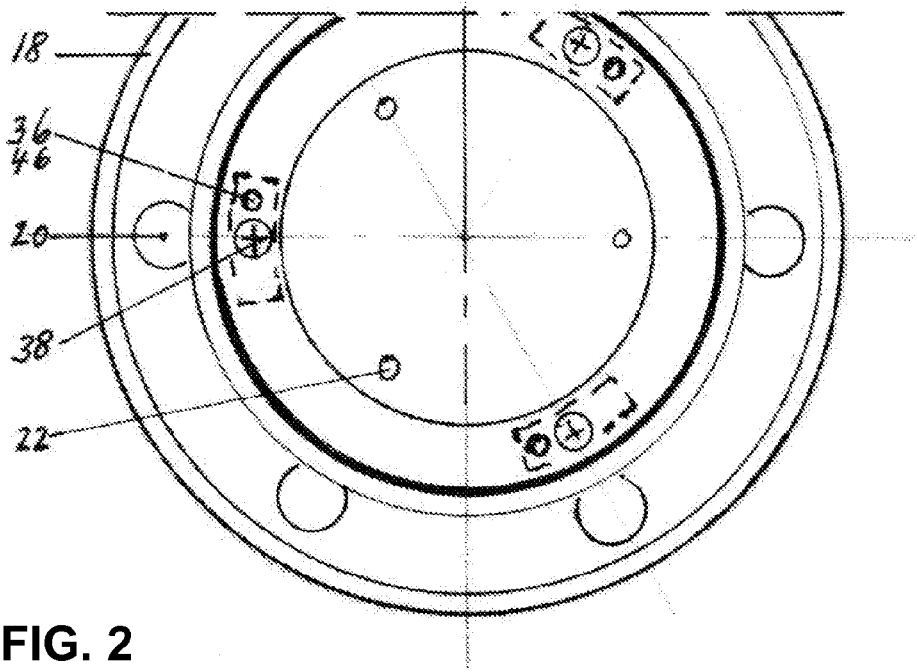
FIG. 2 is a plan of the spot light of FIG. 1 with the LEDs, glass cover and chamber seal removed.

Referring now to the drawings, a low voltage (LV) spot light intended as a replacement for an existing PAR38 lamp comprises a standard Edison screw cap 2 mounted at the corner end of a frusto conical housing 4 which merges into a cylindrical shape 6. This housing 4/6 is made from UV stabilised plastics and contains the electronic power supply 52 . The outer profile of the casing from the base 2 to a position adjacent the transition from the conical housing 4 to the cylindrical shape 6 matches the profile of existing PAR38 lamps, thus permitting the spot light to be fitted into an existing PAR38 lamp holder which consists of a tubular socket with an annular seal interposed between the lamp holder and the conical housing to form a weather- and dust-proof seal between the spot light and the lamp holder. This arrangement protects the electrical contact area from contamination.

At the opposite end of the spot light the LED chamber 12 made from Aluminium alloy with circular flange 14 seats on the central portion of Aluminium dish 18. The dish is 120 mm in diameter and apart from the central portion 16 it is powder coated black. The base of the dish outside the collar 12 has 6 evenly spaced holes 20, about 10 mm in diameter for ventilation cooling and drainage.

The circuit board supporting a cluster of LEDs lies inside circular flange 14. Dependent on the design of the LED cluster and the specification of the supplier, they are either mounted on base plates for connection onto the heat sink 18 with screws or with double-sided temperature conducting tape. The collar 12 creates the LED chamber 30 in-to which the LEDs emit heat. The chamber is closed off by glass cover 42 held in place by rim seal 34 (e.g., a weatherproof annular seal made from UV stabilised elastic material like Santoprene). The seal 34 has one dust and insect protected vent and can be rotated for positioning of the vent opening to face downwards regardless of the installed spotlight orientation. The seal 34 contains a single dust and insect protected vent 28. The dish also has a trio of (or at least 3) passages 46—which allow electrical leads 32 to access the LEDs and holes 22 for internal ventilation.

The flange 14 is attached to the central portion 16 of the dish by three screws 38. Each screw passes through the dish into an arcuate spacer 40 which extends from a circular lid 26. The spacers are about 11 mm long and create an air gap 44 between the lid 26 and the underside of the lower tray 48. This permits the option for weather protected ventilation. Adjacent to each screw hole in the spacer is a passage 46 which aligns with a matching passage 36 in the dish. These holes lead the wires 32 from the power supply 52 to the LED cluster.

The circular tray 48 is locked into position between the spacers 40 and the underside of dish 18. The well protected centre of the tray 48 has a vent opening with internal filter 50 to provide dust and insect protected ventilation.

Both the vents 28 and the vent opening are internally fitted with dust filters treated with insect repellent (like surface spray) to prevent entry of insects. The filters can be cotton balls or other suitable material held in position by silicon glue or similar.

The contact surfaces between flange 14, dish 18 and tray 48 are treated with heat sink compound to ensure reliable heat transfer.

The interior of the cylindrical housing 6 accommodates an electronic power supply 52 which steps the incoming voltage down to the voltage required by the LED cluster. The power supply 52 is in the form of an insulated switch mode transformer for the AC input combined with a constant current DC output for the LEDs, including protection.

The metallic LED chamber consisting of upper body 12 and lower tray 48 optimises the cooling surface of the heat sink. The chamber is accessible via the removable window 42. This permits replacement of the LEDs with alternative types such as ones with different efficiency, different colours or otherwise different characteristics. It is a commercial decision to either use multi-element LED modules in combination with commercially available reflectors, a common reflector 56, or LEDs with integrated collimators to generate the required light beam. The common reflector 56 is installed by, for example, clamping it under a seal (e.g., the seal 34).

Naturally the best efficiency is achieved with the lowest possible operating current and an increased number of LEDs.

The constant current power supply 52 is rated for an Extra Low Voltage (ELV) output up to 24V. The input is universal for 90 to 240V, 47 to 64 Hz for ambient temperatures of −40 to +50° C. with protection against short circuit, over current and over voltage. It is encapsulated in permanent elastic potting 54 and meets international safety requirements.

In an advantage, the invention provides superior efficiency with low power consumption.

In another advantage, the invention provides long service life—only limited by the power supply to about 50.000 hrs.

In another advantage, the invention provides relatively low, non-dangerous surface temperatures.

In another advantage, the invention is light weight, below 400 g.

In another advantage, the intensive development of LEDs will not only improve the efficiency resulting in reduced power consumption but will result in cost reductions as more applications will result in higher production quantities.

In another advantage, the LEDs emit about 50 lumens/watt of warm white directional light at current state of art.

In another advantage, the LED chamber is weather proof ventilated to inhibit or prevent condensation.

In another advantage, the LEDs can be changed because they are accessible through the removable window.

In still another advantage, the spot light can be used with existing outdoor PAR38-style lamp holders and existing indoor standard E27 lamp holders.

It is to be understood that the word "comprising" as used throughout the specification is to be interpreted in its inclusive form, i.e. use of the word "comprising" does not exclude the addition of other element. Various modifications of and/or additions to the invention can be made without departing from the basic nature of the invention and these modifications and/or additions are therefore considered to fall within the scope of the invention.

What is claimed is:

1. A spotlight for outdoor use, the spotlight comprising:

a base for connecting to an electrical socket;

a housing shaped for sealing engagement with a mains voltage PAR38 style outdoor lamp holder to protect the electrical contact area of the based and the socket from water;

a step-down device for reducing an incoming mains voltage to an LED voltage, the step-down device being sealed within the housing to protect the step-down device from water;

an LED chamber containing one or more LEDs powered by the LED voltage, the LEDs having a combined light output equivalent to a PAR38 reflector lamp;

spacers extending from the housing to the LED chamber, the spacers defining an air gap separating the step-down device from the LED chamber, the air gap allowing free-flowing ambient cooling air to flow between the step-down device and the LED chamber, wherein the spacers are integral with a lid over the step-down device and contain passages which provide paths for leads from the step-down device to the LEDs; and one or more heat-sink elements in contact with the LED chamber and the air gap for conducting heat away from the LEDs, whereby the spotlight is a substitute for a PAR38 reflector lamp;

wherein a lower portion of the LED chamber has in its protected centre a vent opening which provides ventilation to inhibit condensation in the chamber.

2. A spotlight as claimed in claim 1, wherein the heat sink elements include a one-piece metal dish for heat emission to the ambient air.

3. A spotlight as claimed in claim 2, wherein the metal dish is made from an Aluminium alloy 2-4 mm thick or from another metal with equivalent thermal conductivity.

4. A spotlight as claimed in claim 2, wherein the metal dish has ventilation passages in the central area which opens into the LED chamber for internal ventilation against condensation.

5. A spot light as claimed in claim 2 wherein the metal dish and the LED chamber have a dark coating to increase emissivity.

6. A spot light as claimed in claim 2, wherein the metal dish comprises a smooth finless surface and has openings for air flow and drainage, the openings being positioned adjacent to the outside of the LED chamber.

7. A spotlight as claimed in claim 2, wherein the LEDs are attached to a central portion of a floor of the LED chamber.

8. A spotlight as claimed in claim 1, further comprising directional reflectors including any one or more of: one reflector for the LEDs, reflectors for groups of LEDs, and individual collimators for individual LEDs.

9. A spotlight as claimed in claim 1, wherein the LEDs require about 14 W at ELV to provide the light output up to about 100 W.

10. A spotlight as claimed in claim 1, further comprising:

a forward end portion with the heat-sink elements made of metal; and a rear end portion made of UV-stabilised plastics, wherein the metal forward end-portion is attached to the forward end of the plastic rear-end portion; and an Edison screw cap is attached to the rear of the plastic rear-end portion to form the base.

11. A spotlight as claimed in claim 1, wherein the lid over the step-down device includes a rim flange at its forward end for confining adhesive used during assembly.

12. A spotlight as claimed in claim 1, wherein the step-down device comprises an insulated switch mode transformer for universal AC input of 90-264 V, 47-64 Hz at an ambient temperature of about −40 to +50° C. and a constant current DC ELV output, embedded in permanent elastic potting for uniform heat distribution and to provide double insulation in combination with the plastics enclosure.

13. A spot light as claimed in claim 1, further comprising a removable transparent cover attached to the chamber using a weatherproof annular seal made from UV-stabilised elastic material.

14. A spot light as claimed in claim 13, wherein the weather-proof annular seal has one dust-projected and insect-protected vent for condensation inhibition, wherein the annular seal can be rotated to face the vent downwards regardless of the installed spotlight orientation.

15. A spotlight as claimed in claim 1, wherein the base is configured for engagement with a socket of the mains voltage PAR38-style outdoor lamp holder, and/or with a socket of a standard E27 indoor lamp holder.

16. A spotlight as claimed in claim 1, further comprising a transparent cover for the LED chamber, wherein the LED chamber is weather-proof and vented against condensation.

17. A spotlight as claimed in claim 1, wherein the LEDs are in an LED spotlight cluster.

18. A spotlight as claimed in claim 1, wherein the LED's chamber vent opening provides the ventilation in combination with a vent in a weather-proof annular seal on the LED chamber, and wherein the vent opening and the vent are internally fitted with dust filters treated with surface spray insect repellant to prevent entry of insects, wherein the filters are cotton balls held in position by silicon glue.

* * * * *